US005806316A

United States Patent [19]

Avakov et al.

[11] Patent Number: 5,806,316

[45] Date of Patent: Sep. 15, 1998

[54] APPARATUS AND METHOD FOR PRODUCING WORKING FLUID FOR A POWER PLANT

[75] Inventors: Aram Avakov; Serquei Avakov, both of Moscow, Russian Federation

[73] Assignee: New Systems International Limited, St. Helier, Channel Islands

[21] Appl. No.: 325,452

[22] PCT Filed: Apr. 29, 1993

[86] PCT No.: PCT/GB93/00895

§ 371 Date: Jan. 24, 1995

§ 102(e) Date: Jan. 24, 1995

[87] PCT Pub. No.: WO93/22541

PCT Pub. Date: Nov. 11, 1993

[30] Foreign Application Priority Data

Apr. 29, 1992 [SU] U.S.S.R. ..... 5035237
Apr. 29, 1992 [SU] U.S.S.R. ..... 5035238

[51] Int. Cl.[6] ..... F01K 25/06

[52] U.S. Cl. ..... 60/644; 60/673

[58] Field of Search ..... 60/649, 673

[56] References Cited

U.S. PATENT DOCUMENTS

| | | | |
|---|---|---|---|
| 3,943,719 | 3/1976 | Terry et al. | 60/644 |
| 4,397,153 | 8/1983 | Terry et al. | 60/649 |
| 4,485,629 | 12/1984 | Goff | 60/673 |
| 4,622,820 | 11/1986 | Sundquist | 60/673 |

FOREIGN PATENT DOCUMENTS

| | | |
|---|---|---|
| 3150-900 | 6/1983 | Germany . |
| 70147 | 10/1948 | U.S.S.R. . |
| 1170180 | 7/1985 | U.S.S.R. . |
| 1276841 | 12/1986 | U.S.S.R. . |
| 1534193 | 1/1990 | U.S.S.R. . |

*Primary Examiner*—Noah P. Kamen
*Attorney, Agent, or Firm*—Reid & Priest LLP

[57] ABSTRACT

Apparatus and a method for forming a gas hydrate for use in the production of pressurised gas due to the decomposition of the gas-hydrate in a storage chamber, and for controlled delivery of the pressurised gas as working medium to a turbine engine which is preferably coupled to a generator for the production of electricity.

32 Claims, 6 Drawing Sheets

APPARATUS AND METHOD FOR PRODUCING WORKING FLUID FOR A POWER PLANT

The present invention relates an apparatus and method for producing working medium for supply to an engine of a power installation. More especially the invention relates to the area of power-plant engineering of electricity-generating installations for the transformation of low-potential and high-potential thermal energy into mechanical and electrical energy, and also in the area of a means of preparation of a working medium for such installations.

TECHNICAL BACKGROUND

There exists an electricity-generating installation containing a high-potential heat source. The installation has a closed circuit with an intermediate heat-transfer medium, a power turbine, heat-exchangers for heating and cooling the working medium. Patent USSR No. 70147, Int. class. F03G7/00, publ. 1948 applies.

There also exists an electricity-generating installation containing a turbine for driving a load, a cooler, a circulating pump and two or more chambers for preparing the working medium, all of the above connected by means of pipelines. The chambers are connected to the turbine and have a heater, a separator and sealing devices at the outlet. The circulation pump is connected to the cooler and to each of the chambers to form a circuit for the circulation of liquid. Patent USSR No. 1170180, Int. class FO125/00, publ. 1985 applies.

There exists a means for the preparation of the working medium of an electricity-generating installation, consisting in the filling of an intermediate heat transfer medium circuit with a volatile liquid and its subsequent evaporation in an heat-exchanger by air compressed in an compressor and the supply of the vapour to the turbine. Patent USSR No. 70147, Int. class F03G7/00, publ. 1948 applies.

There also exists a means for the preparation of the working medium of an electricity-generating installation, including the filling of one or more chambers with a liquid, the introduction into one of the chambers of an additional component and the raising of its pressure, the heating of the working medium formed in it and, following the supply of the working medium to the turbine, the performance of these operations in another chamber. Patent USSR No. 1170180, Int. class F01K25/00, publ. 1985 applies.

Further, U.S. Pat. No. 3943719 discloses apparatus for supplying working medium to an engine (e.g. turbine), this apparatus comprising generating means for producing working medium and delivery means for supplying said working medium to an engine. In particular the generating means comprises reactor means for the formation of a compoung (i.e. hydride) from which the working medium (i.e. Hydrogen) is obtained, while storage means are provided for holding said compound formed by said reactor means, said delivery means including control means for controlled delivery of working medium from the storage means to the engine.

According to one aspect of the present invention there is provided apparatus for supplying working medium for a gas expansion engine comprising generating means for producing working medium, storage means for the working medium, and delivery means for supplying the working medium to an engine from the storage means, the delivery means including control means for controlled delivery of the working medium from the storage means to the engine wherein the generating means comprises reactor means arranged and adapted for the formation of a gas-hydrate from which the working medium for the engine is obtained, the storage means holding the gas hydrate formed by the reactor means, and a liquid recirculation circuit is provided for recycling liquid discharged from the reactor means back to the reactor means, the recirculation circuit including a recirculating pump and a heat-exchanger. The method in particular using water condensate from a steam turbo-generator plant for the production of the gas hydrate (with a further component) in a reaction chamber, the gas hydrate so produced being stored in suitable storage means in readiness for the formation of the working medium.

DISCLOSURE OF THE INVENTION

The principal object of the present invention is to raise the efficiency of an electricity-generating installation by means of the exclusion of wasteful losses of heat and mechanical energy, the use in the working cycle of low-potential and high-potential heat and the creation of an ecologically sound system for the transformation of heat to work.

To meet this object there is provided apparatus for supplying working medium to a gas expansion engine, as set out in the appended claim 1.

Preferably, the storage means comprises a plurality of separate containers, the delivery means including conduit means for supplying working medium to the engine from the containers and in that the control means comprise valves operable for sequential delivery of working medium from the containers to the engine via said conduit meams.

In addition, the apparatus may be provided with a gas supercharger, connected to the containers so as to form one or more circuits for gas recirculation. The containers may be constructed with one or more external separators and/or one external reactors connected via a gas-hydrate emulsion outlet to the containers, while the separator is situated at the outlet of the chambers and connected via its liquid outlet to the inside volume of the chambers, which are in addition connected to a circuit for the circulation of liquid. The apparatus can include a heater and cooler constructed in the form of a single heat-exchange device, supplied intermittently from external sources with two heat-transfer media at different temperatures. The apparatus may also be fitted with an electrolyzer, and the load may take the form of a generator, with the electrolyzer being connected to the generator and the working-chamber being connected to an additional heat-exchanger so as to form an additional heat recovery path to add the heat produced by electrolysis to the working media of the system before it enters the engine (turbine). The installation may be fitted with an additional turbine, and the electrolyzer may be constructed to accept oxygen and hydrogen and be fitted with an oxygen outlet which is connected to the additional turbine.

According to another aspect of the present invention there is provided a method of producing a working medium for supply to a gas expansion engine comprising introducing liquid and an additional component such as water and a gas into a reaction chamber to form by reaction a gas-hydrate from which the working medium is obtained and storing the gas-hydrate so produced in storage means, wherein for maintaining desirable conditions of reaction in the reaction chamber the liquid discharged from the reaction chamber is passed in a recirculating circuit including heat exchanger means back to the reaction chamber. Thus the present invention can encompass the introduction into one or more chambers filled with liquid of a low-pressure gaseous component, which is absorbed by the liquid to form a solid-phase compound, which subsequently when heated decomposes in the same chamber or another chamber and produces a high-pressure gas-phase working medium for electricity-generating installation, which medium drives the turbine. The substances used for the liquid and gas-phase components are, respectively, water and a gas such as a methane-propane mixture, which reacts with water to form a gas-hydrate, while (optimal) conditions of heat-mass transferring process in the chamber are achieved by the water's being recirculated and cooled by an external heat-transfer medium, and also by the recirculation of the gas which has not reacted. In addition, before the working medium is supplied to the turbine, it may be additionally heated by a heat-transfer medium at a high temperature.

BRIEF DESCRIPTION OF THE DRAWINGS

Embodiments of the present invention will now be described by way of example with reference to the accompanying drawings wherein:

Referring to FIG. 1, an electricity-generating installation comprises a turbine 3 for driving a load in the form of an electrical generator 4 and two or more chambers 5, 6 constructed with a reactor for the formation of gas-hydrate from which the gaseous working medium for the turbine 3 is obtained, pipelines 1 and 2 serving for the supply of working medium to the turbine 3 and medium discharge therefrom respectively, the pipelines 1, 2 forming a closed circuit with the turbine 3 and chambers, 5, 6. The chambers 5, 6 include emulsators 7, 8 and separators 5S, 6S in the upper section of the chambers 5, 6. The chambers, 5, 6 are included via the circulation pumps 9, 10 in the circuits for the circulation of liquid 11, 12, the circuit including heat-exchange devices 13, 14, which are external selective heaters and coolers supplied through the pipelines 15, 16 and the adjustable three-phase valves 17, 18 from external sources intermittently with two heat-transfer media at different temperatures. The substance used for the heating heat-transfer medium may be a low potential heat-transfer liquid such as water heated by means of waste heat from industrial installations, or by means of solar converters, thermosorbent heat-pump installations, or the heat from the condensation of steam, for instance, in industrial and natural sources. The substance used for the cooling heat-transfer medium may be any fluid with a temperature lower than the substance H of the heating heat-transfer medium. The heat-transfer media may be water obtained from any suitable source, for example from various depths in reservoirs so as to obtain water at a suitable temperature level. The temperature of the heating heat-transfer medium may be, for instance, 28° C. (see FIG. 4, point B') and the temperature of the cooling heat-transfer medium, for instance, 4° C. (see FIG. 4, point A'). The installation may be fitted with an additional heat-exchanger 19 using a high temperature heat-exchange medium and installed prior to the turbine 3 for heating the working medium passing to the turbine 3. The substance used as a high temperature heat-exchange medium may be the exhaust gases from internal combustion engines, the flue gases from industrial installations and so forth. The installation is fitted with a gas-supercharger 20 or compressor connected to the chambers 5, 6 via the adjustable three-phase valve 21, and via the settable valves 22, 23 for recirculating gas which has not reacted in the chambers 5, 6. The gas-supercharger 20 is included in the recirculation circuits 24, 25 with the common outlet pipe 26. The chambers 5, 6 are included in the gas circulation circuits 29, 30 which include settable closure valves 27 28. The substance used as a working medium in the installation is a gas-hydrate compound formed and decomposed in the installation, for instance an 85 per cent methane plus 15 per cent propane mixture of the type $(CH_4+C_3H_8)$ * $6H_20$ with a relative specific weight of 0.6. It is possible to use special additives, for example, glycol in the water, which increase the efficiency of the process by which the working medium (gas hydrate) is produced. For preparation of the working medium one of the chambers is filled with water, for instance chamber 5 (FIG. 1) via the open valve 22 with valves 23 and 27 closed, and valve 21 closed to close the circuit 24. Gas is passed through this water, for instance a methane-propane mixture, via the emulsator 7 until the pressure in chamber 5 is raised to the level required for the formation of gas-hydrate, for instance 15 atmospheres (see point A in FIG. 4). The formation of the gas-hydrate releases heat within the reactor chamber. In order to stabilise the reaction to form gas hydrate in chamber 5, the pump 9 pumps the water from chamber 5 through the heat-exchange device 13, which is supplied with a cooling heat-transfer medium. At the same time the supercharger 20 is used to recirculate the gas which has not reacted. The process of formation of the gas-hydrate is halted when the chamber is substantially filled with gas-hydrate. Following this, valve 17 is used to introduce a hot (warm) heat-transfer medium into the heat-exchange device 13, and the heat is transferred to chamber 5, which results in the disassociation of the gas-hydrate under high-pressure. The pressurised gas which is released is separated from droplets of water by the separator 5S in the upper section of chamber 5. This results in the establishment in chamber 5 of a working pressure corresponding to the temperature of decomposition of the gas hydrate (see FIG. 4, point B), for instance 300 atmospheres. Following this the valve 27 is opened and the high pressure gas is supplied to the turbine 3 for the production of work and the driving of the generators, for instance, of the generator 4. At the same time as gas is supplied to turbine 3 the heating of water in chamber 5 is continued. During the supply of gas from chamber 5 to the turbine the operations described above for the production of gas-hydrate are performed in chamber 6, using the valves 23, 28 and the heat-exchange device 14. When the pressure begins to fall in chamber 5 due to all of the gas hydrate having now decomposed, the valve 27 is closed, and the heating of water in chamber 6 begins. After a working pressure has been developed in chamber 6, valve 28 is opened and the pressurised gas is supplied from chamber 6 to the turbine 3. Where there is a source of a high-temperature heat-transfer medium the heat exchanger 19 is used to further raise the temperature of the gas prior to the turbine, thereby increasing the power of the turbine. A regular supply of gas to the turbine 3 and a minimal fluctuation of pressure in the circuits are achieved by the installation of the requisite number of the above mentioned reactor chambers and their operation in phased sequence. The installation may be constructed with an external reactor 54 (FIG. 2), connected via its outlet 32 through the circulation pump 33 and through the adjustable valves 34 and 35 to the chambers 5A and 6A. In turn the chambers 5A, 6A are connected via the adjustable valves 36, 37 and the pipeline 55 to the cooler 38, and thereby with the circuit 39 for the circulation of liquid and with the pump 39A, which is connected to the lower section 56 of the reactor 54. The supercharger 20 is connected to the upper section 31 of the reactor 54, to the exhaust pipe 2 and to the emulsator 7A so as to form the gas circulation circuit 40. The installation may include an external separator 41, connected to the upper sections of the chambers 5, 6 and connected via its exit pipe 42 to the liquid circulation circuit 43 which includes the heater 44, using a low-potential external heat-transfer medium, the pump 45, and the adjustable valves 46–49, connected to the chambers 5, 6. In addition when a large number of chambers is used the separator 41 performs the functions of a receiver, which supplies a regular supply of gas to the turbine 3.

Figure 1:
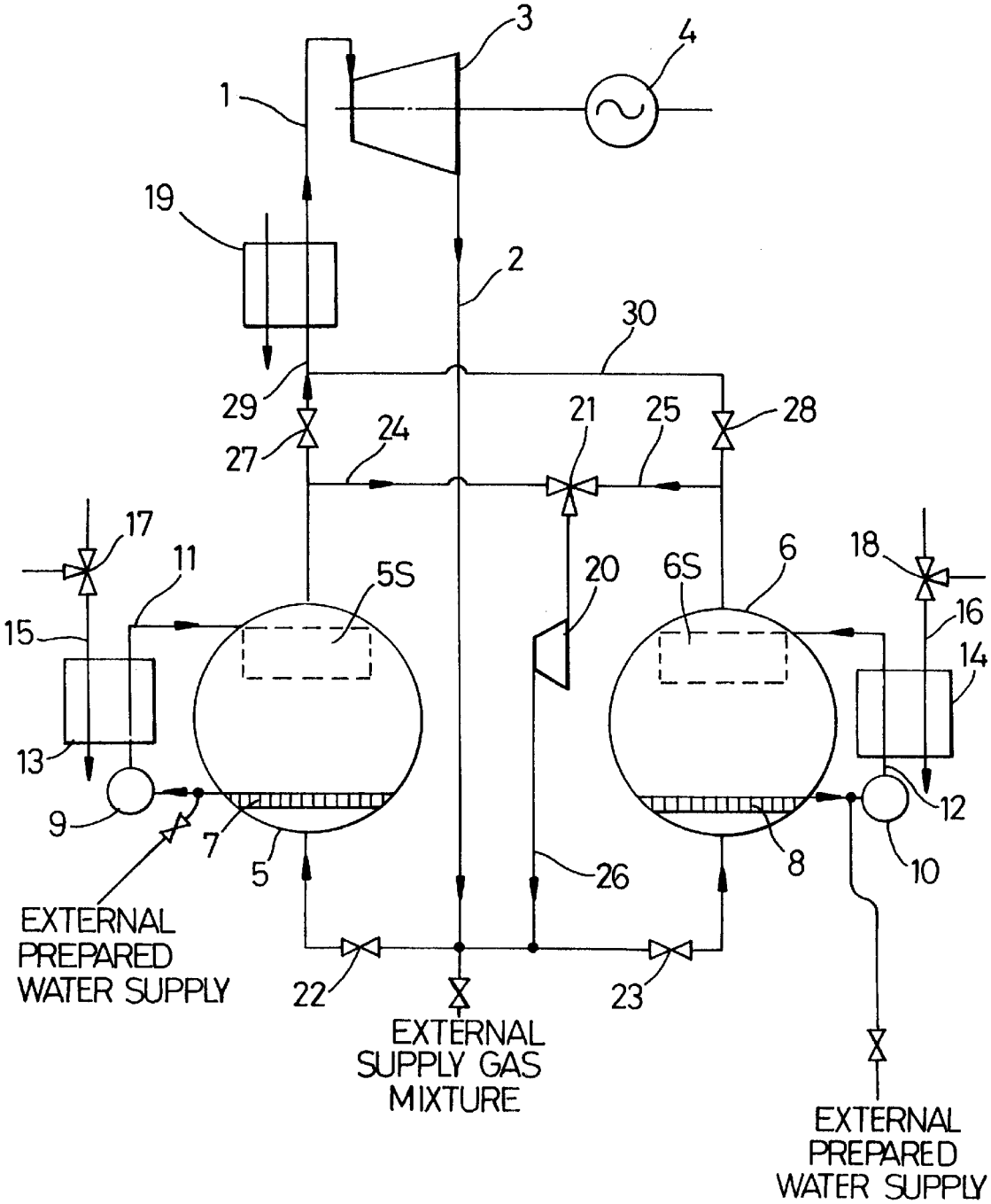
FIG. 1 shows schematically an electricity-generating installation in accordance with a first embodiment of the present invention.
Figure 2:
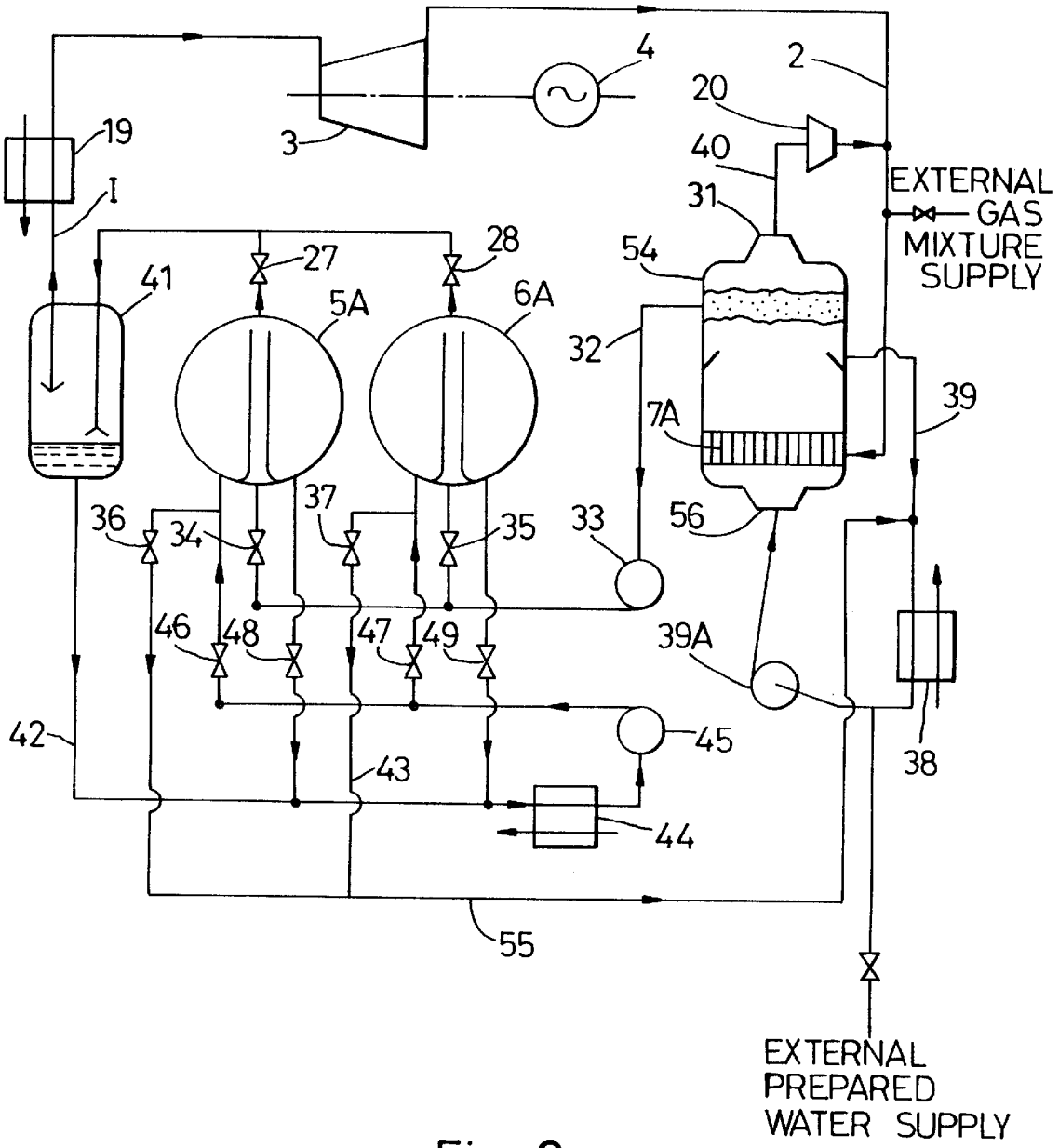
FIG. 2 shows schematically an electricity-generating installation according to a second embodiment.
Figure 3:
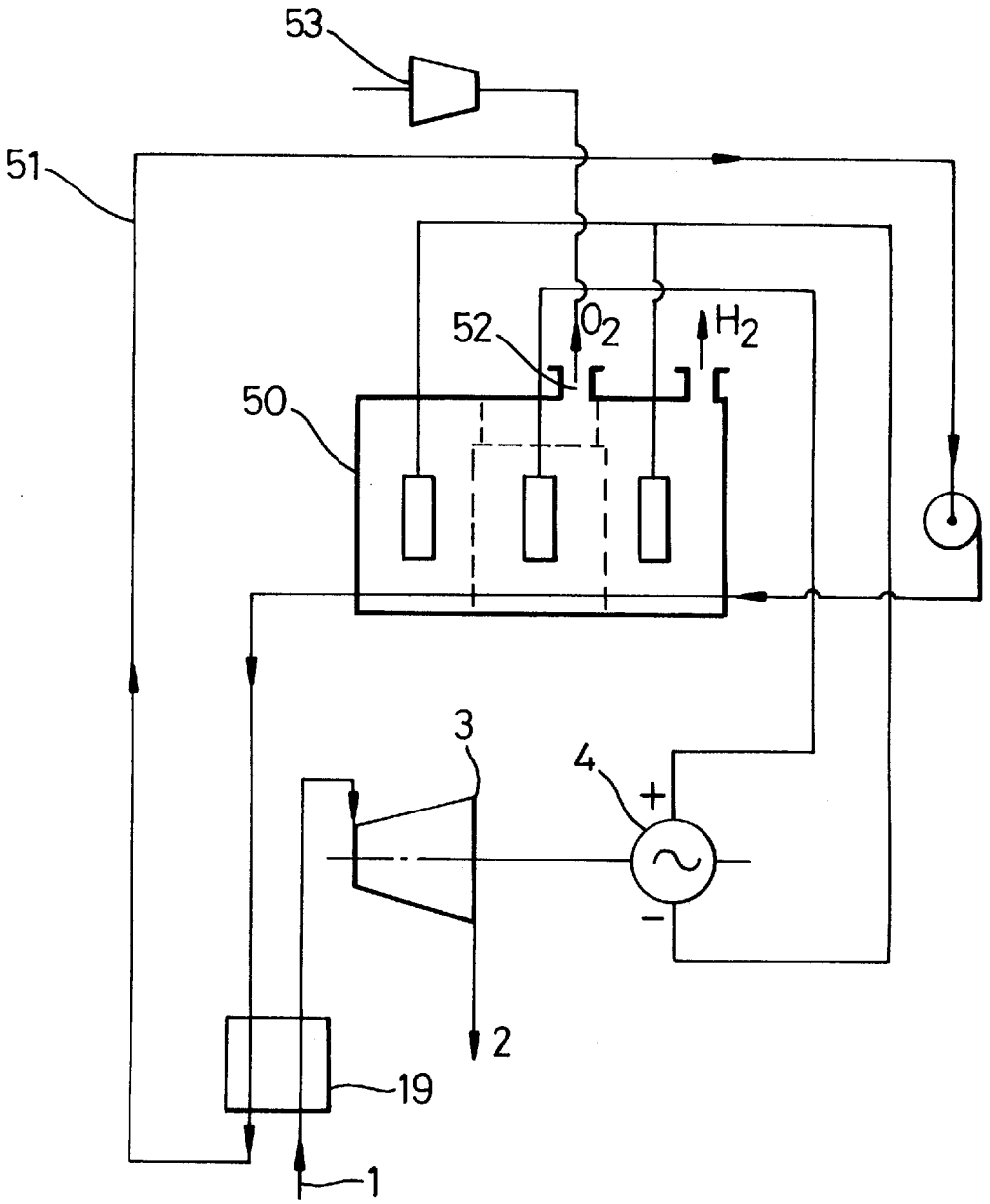
FIG. 3 shows electrolyser apparatus which can be used in the installation of FIGS. 1 and 2.
Figure 4:
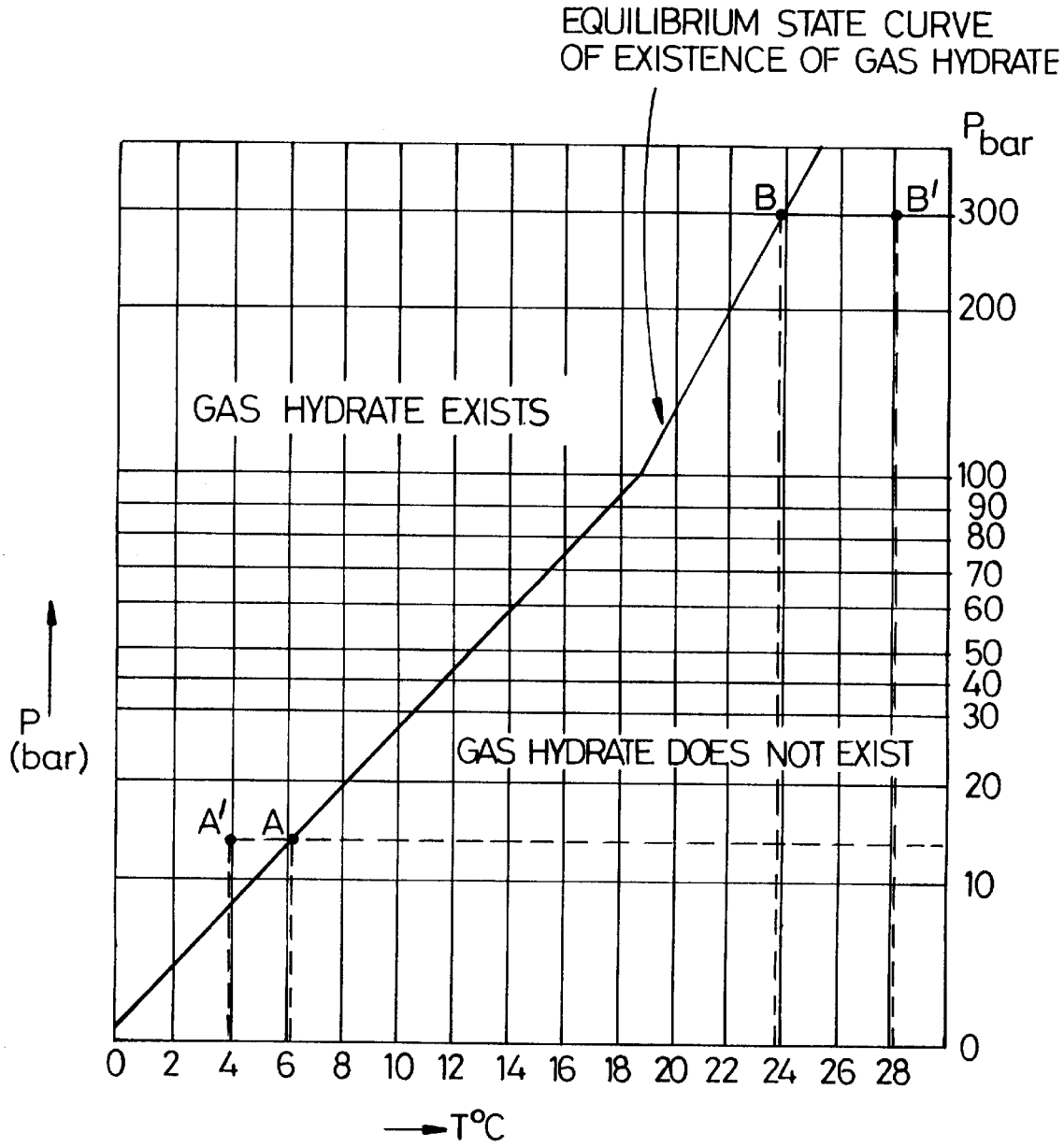
FIG. 4 is a graph of the state of thermodynamic equilibrium of a gas-hydrate compound, in particular the methane-propane mixture $(CH_4+C_3H_8)\times 6H_20$ with a relative specific weight of 0.6.

The installation may be fitted with an electrolyser 50, while the load of turbine 3 takes the form of the generator 4. In this case the working chamber of the electrolyser 50 is connected to the additional heat-exchanger 19, using a high-temperature heat-transfer medium, so as to form the additional circulation circuit 51 for the return of the heat of electrolysis to the work cycle of the installation. The electrolyser 50 may be equipped, for instance for the production of hydrogen and oxygen, with an outlet 52 for oxygen connected to an additional turbine 53. For the installation constructed with an external reactor 54 and a separator 41, the formation of the gas-hydrate is carried out outside the storage chambers 5, 6. This is done by filling the reactor 54 and the liquid circulation circuit 39 with water distilled (which may contain additives) from an external storage tank. When the system has been filled with water the above-mentioned working gas is pumped through the emulsator 7A with the valves 34, 35 closed. At the same time water is continuously circulated through the cooler 38 and the gas which has not reacted is circulated using the impeller fan 20. The gas-hydrate emulsion formed in the reactor 54 is pumped by the pump 33 into one of the chambers, for instance chamber 5A, with the valve 34 open and the valve 27 closed. As the gas-hydrate fills the chamber is displaces the remaining water along the pipe-line 55 into the circuit 39. Following this, the valves 46, 48 are opened and the valves 34, 36 are closed, and the water is pumped by the pump 45 through the heater 44. At the same time in the chamber 5A the gas-hydrate is dissociated under high pressure, and the gas accumulates in the storage section of chamber 5. When the temperature of the water being pumped through the heater 44 is stabilised, the valve 27 is opened and the gas at working pressure enters the separator 41, where it is separated from water droplets and then it is introduced via the pipe 1 into the turbine 3. At the same time the pumping of water through the heater 44 continues. When all the gas has emerged under a constant pressure from the chamber 5A, the valves 46 and 48 are closed. Following this, the process described above is repeated using chamber 6A, and chamber 6A is filled with gas-hydrate. The spent gas from the turbine is led along the pipeline 2 into the emulsator 7A and the gas bubbles through a layer of water in the rector 54, with the result that the gas-hydrate is produced continuously in the process of the installation's operation.

If an external separator 41 is installed when there is a large number of chambers, it may also be used as a receiver which excludes fluctuations in the pressure of the gas in the system. If the installation uses an electrolyser 50, its working chamber is connected to an additional heat-exchanger 19, using a high-temperature heat-transfer medium, which makes it possible to exploit the heat of electrolysis. In accordance with the invention, the installation possesses a high degree of operational reliability as a result of the absence of high thermal or mechanical stresses, it allows the use of inexpensive construction materials, and its working cycle is automatically regulated to a high degree. The invention should enable a considerable reduction in the cost of producing electricity.

Figure 5A:
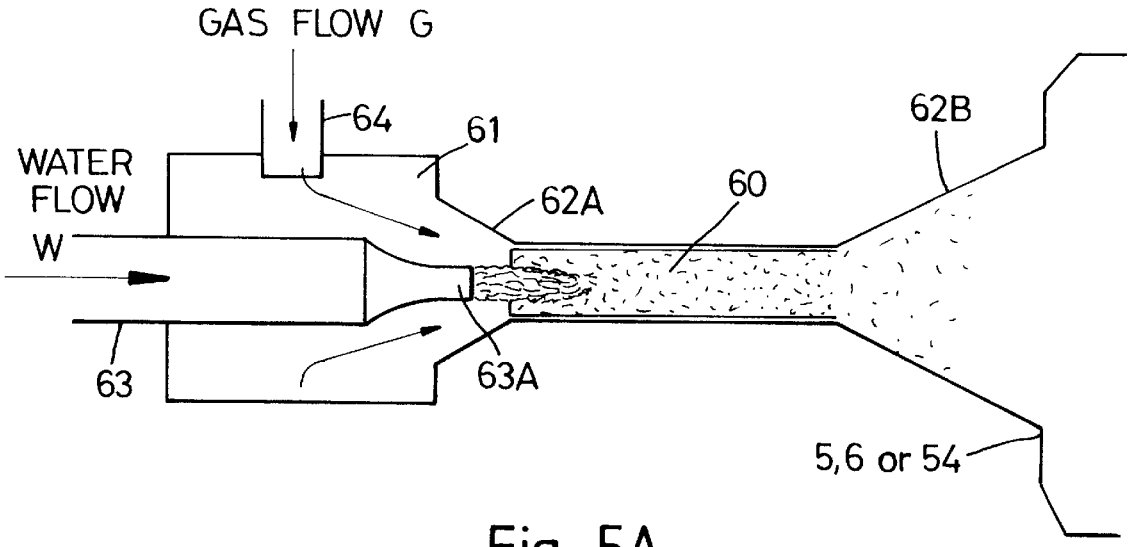
FIGS. 5A, 5B and FIG. 6 show modifications.

FIG. 5A shows a modification to provide more efficient formation of gas-hydrate, and also give a greater power generating facility. The modification operates on an induction principle by drawing or sucking the gas into the water flow, and the arrangement is described as a liquid-jet (or stream) inducer or injector. Thus, there is provided a mixing chamber 60 in a throat with an inlet manifold 61 of larger cross section to one side while a diverging discharge 62B at the other side leads to the chambers 5, 6 or 54. An inlet pipe 63 for the high pressure recirculated water extends into the manifold 61 and has a discharge nozzle 63A located at the converging inlet 62A of the throat, while a further inlet pipe 64 feeds the gas to the manifold 61. In operation, the recirculated high-pressure cooled water W is discharged from the nozzle 63A, and the gas in the manifold 61 is sucked into the flowing water via jet inlet 62A and mixing of the gas and water occurs in the mixing chamber 60 resulting in efficient and effective formation of gas hydrate.

Figure 5B:
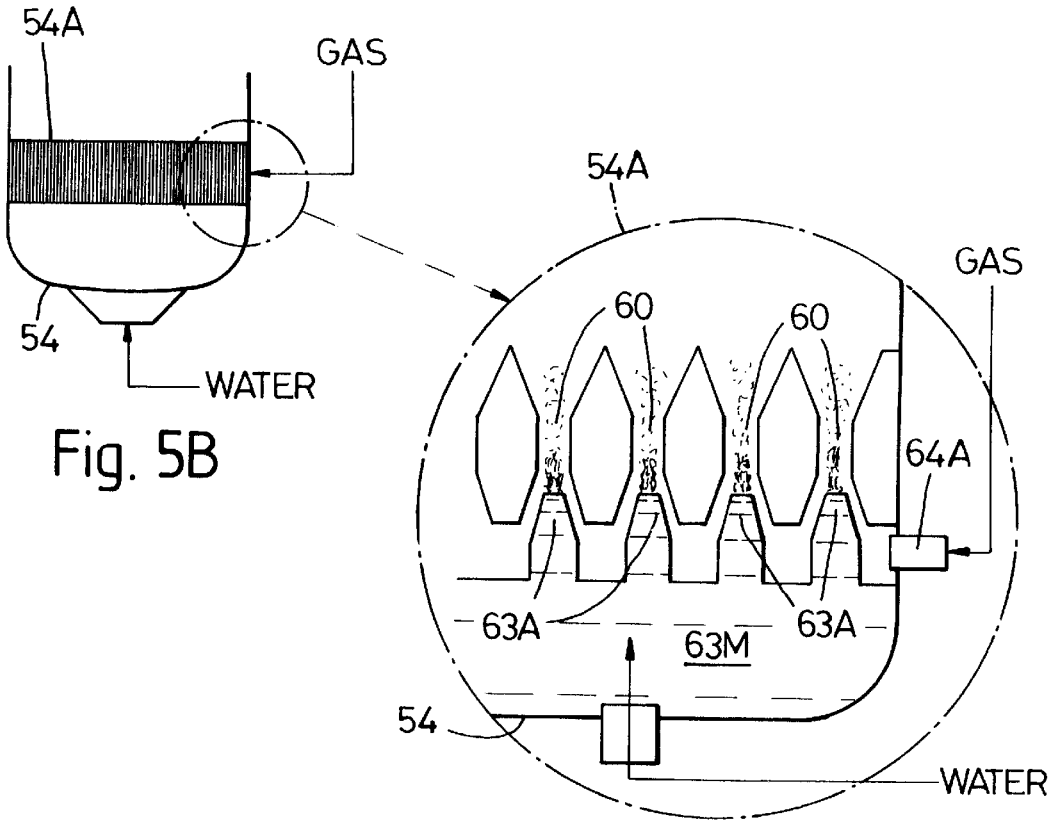

FIG. 5A shows a single liquid jet inducer, but it would be possible to employ a bank (or battery) of such devices for greater output of gas hydrate and consequently greater power capacity, and FIG. 5B shows the provision of such a battery. In this case the inducer bank is located at zone 54A in the chamber 54 and comprises an aligned array of throats defining a plurality of mixing chambers 60. The high-pressure cooled water is fed to a manifold formation 63M in the chamber 54 having a plurality of nozzle discharges 63A each corresponding to a relevant mixing chamber 60 (all generally as in FIG. 5A). while the gas is led to an inlet 64A appropriately located on the chamber 54. Operation of the inducer bank of FIG. 5B is exactly similar to the inducer of FIG. 5A.

Figure 6:
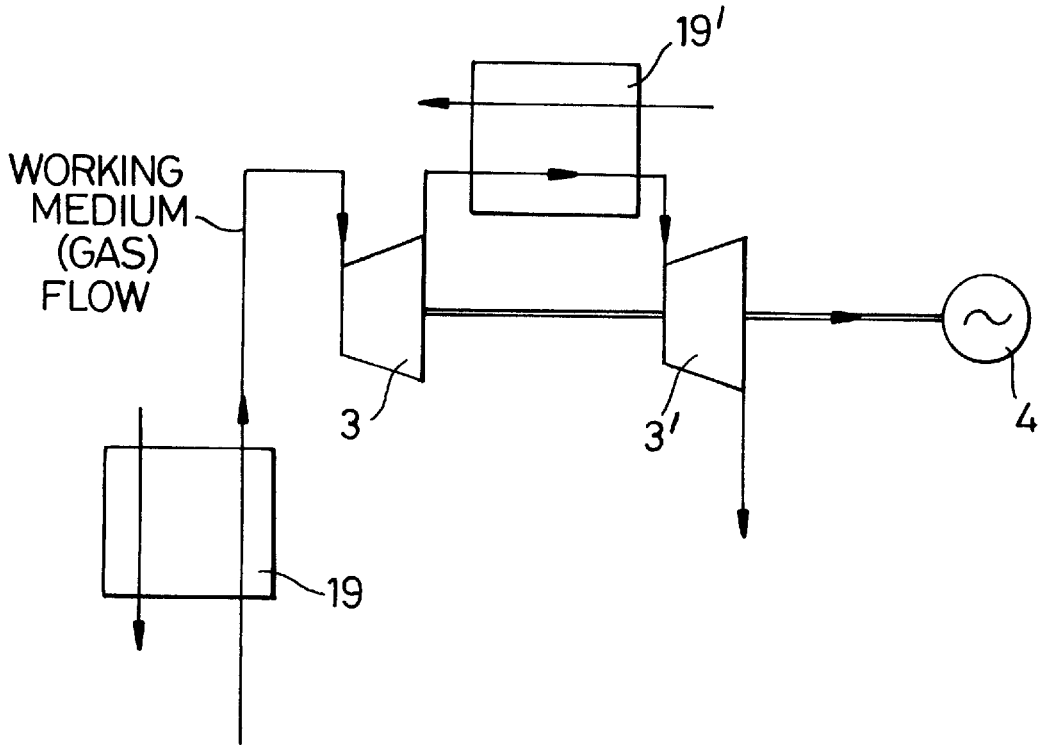

FIG. 6 shows an alternative power generating arrangement usable in the inventive system, wherein two or more expansion engines in the form of turbines 3,3'. . . are arranged in series with working medium produced from gas hydrate passing serially through the turbines, and an additional heat exchanger 19' is located in the flow path between successive turbines 3,3' for intermediate heating of the working medium passing between the turbines to provide greater efficiency in the operation of the power generating arrangement.

INDUSTRIAL APPLICATIONS

The invention is intended for the creation of permanent, ecologically sound electricity-generating installations, utilising renewable natural sources of low-potential thermal energy. The invention may be used in combination with various power-intensive technological processes which produce waste heat, which is transformed in the installation into useful work, with a high degree of efficiency, for instance for the economically effective production of hydrogen.

The invention could of course be used in installations other than electricity-generating installations, for example, in a pumping installation, and the invention can be utilised to provide working medium for a variety of gas expansion engines generally.

We claim:

1. Apparatus for supplying working medium for a gas expansion engine comprising:

generating means for producing working medium, storage means for the working medium, and delivery means for supplying said working medium to the gas expansion engine from the storage means, said delivery means including control means for controlled delivery of the working medium from the storage means to the engine wherein said generating means comprises reactor means arranged and adapted for the formation of a gas-hydrate from which the working medium for the engine is obtained, said storage means holding the gas hydrate formed by said reactor means, and a liquid recirculation circuit is provided for recycling liquid discharged from the reactor means back to the reactor means, said recirculation circuit including a recirculating pump and a heat-exchanger.

2. Apparatus as claimed in claim 1, wherein the storage means comprises a plurality of separate containers, the delivery means including conduit means for supplying working medium to the engine from the containers, and wherein the control means comprise valves operable for sequential delivery of working medium from the containers to the engine via said conduit means.

3. Apparatus as claimed in claim 2, wherein each storage container has a gas outlet connected to the inlet of the engine, the outlet of the engine being connected to the gas inlet of the reactor means.

4. Apparatus as claimed in claim 2, wherein the containers are constructed with at least one external separator, connected via a gas-hydrate emulsion outlet to the containers, the at least one separator being situated at the outlets of the containers and having a liquid outlet connected to the liquid inlets of the containers, which are in addition connected to the circuit for the circulation of liquid.

5. Apparatus as claimed in claim 2, further comprising return conduit means for return of expanded working medium from the engine to the reactor means, whereby the engine and the working medium supply apparatus operate in a closed cycle.

6. Apparatus as claimed in claim 2, wherein the containers are constructed with at least one external separator and at least one external reactor, connected via a gas-hydrate emulsion outlet to the containers, the at least one separator being situated at the outlets of the containers and having a liquid outlet connected to the liquid inlets of the containers, which are in addition connected to the circuit for the circulation of liquid.

7. Apparatus as claimed in claim 1, further comprising return conduit means for return of expanded working medium from the engine back to the reactor means whereby the engine and the working medium supply apparatus operate in a closed cycle.

8. Apparatus as claimed in claim 1, wherein the heat exchanger comprises a cooler.

9. Apparatus as claimed in claim 8, wherein the heat exchanger comprises a heater and a cooler, the heater and the cooler being constructed in the form of an integral heat-exchange device, supplied intermittently from the external sources with at least two heat-transfer media at different temperatures.

10. Apparatus as claimed in claim 1, wherein the heat exchanger comprises a heater.

11. Apparatus as claimed in claim 10, wherein the heat exchanger comprises a heater and a cooler, the heater and the cooler being constructed in the form of an integral heat-exchange device, supplied intermittently from external sources with at least two heat-transfer media at different temperatures.

12. Apparatus as claimed in claim 1, wherein the reactor means includes a separator.

13. Apparatus as claimed in claim 1, wherein the reactor means include an emulsator.

14. Apparatus as claimed in claim 1, further comprising at least one circuit for the recirculation of unreacted gas to the reactor means and a gas impeller located in the at least one circuit.

15. Apparatus as claimed in claim 1, further including an additional heat-exchanger, using a high-temperature heat-transfer medium, installed immediately prior to the engine, to heat the working medium passing to the engine.

16. Apparatus as claimed in claim 15, further comprising an electrolyzer supplying heating medium to said additional heat exchanger thereby forming an additional circulation circuit, and an electric power source for the electrolyzer.

17. Apparatus as claimed in claim 16 wherein said electric power source comprises a generator driven by the gas expansion engine, the gas expansion engine being supplied with working medium from said storage means.

18. Apparatus as claimed in claim 17, further including an additional turbine, the electrolyzer being equipped with an oxygen outlet connected to the additional turbine.

19. Apparatus as claimed in claim 17, further comprising an additional turbine while the electrolyzer is equipped with a hydrogen outlet connected to the additional turbine.

20. Apparatus as claimed in claim 17, further comprising an additional turbine while the electrolyzer is equipped with an oxygen and hydrogen outlet connected to the additional turbine.

21. Apparatus as claimed in claim 1, wherein there is provided one or more liquid-jet compressor devices for mixing water and gas for the formation of gas hydrate.

22. Apparatus as claimed in claim 21, wherein a bank of said compressor or inducer devices is present; said bank including an aligned array of throat means defining a plurality of mixing chambers for gas and water, a manifold receiving recirculated water and provided with a plurality of discharge nozzles each corresponding to a relevant mixing chamber, and means for supplying gas so that a water jet or stream discharge from said nozzles draws the gas for mixing with the water in said mixing chambers.

23. Apparatus as claimed in claim 21, wherein a bank of said inducer devices is present; said bank including an aligned array of throat means defining a plurality of mixing chambers for gas and water, a manifold receiving recirculated water and provided with a plurality of discharge nozzles each corresponding to a relevant mixing chamber, and means for supplying gas so that a water jet or stream discharge from said nozzles draws the gas for mixing with the water in said mixing chambers.

24. Apparatus as claimed in claim 1 wherein there is provided one or more inducer devices for mixing water and gas for the formation of gas hydrate.

25. A power installation including a gas expansion engine and apparatus for supplying working medium for the gas expansion engine, said apparatus comprising generating means for producing working medium, storage means for the working medium, and delivery means for supplying said working medium to the gas expansion engine from the storage means, said delivery means including control means for controlled delivery of the working medium from the storage means to the engine wherein said generating means comprises reactor means arranged and adapted for the formation of a gas-hydrate from which the working medium for the engine is obtained, said storage means holding the gas hydrate formed by said reactor means, and a liquid recirculation circuit is provided for recycling liquid discharged from the reactor means back to the reactor means, said recirculation circuit including a recirculating pump and a heat-exchanger.

26. A method of producing a working medium for supply to a gas expansion engine, comprising:

introducing liquid and an additional component and a gas into a reaction chamber to form by reaction a gas-hydrate from which the working medium is obtained and storing the gas-hydrate so produced in storage means, and passing the liquid discharged from the reaction chamber in a recirculating circuit including heat exchanger means to maintain desirable conditions of reaction in the reaction chamber.

27. A method as claimed in claim 26, wherein the liquid is cooled in said recirculating circuit.

28. A method as claimed in claim 26, wherein the liquid is heated in said recirculating circuit.

29. A method as claimed in claim 26, wherein gas that has not reacted is recirculated to the reaction chamber.

30. A method as claimed in claim 26, wherein said additional component comprises a working gas capable of producing gas hydrate.

31. A method as claimed in claim 26, further comprising the step of heating the working medium by high temperature heating means prior to delivery to an engine.

32. A method as claimed in claim 26, wherein said additional component comprises methane propane.

* * * * *